US005771497A

United States Patent [19]

Steele

[11] Patent Number: 5,771,497

[45] Date of Patent: Jun. 30, 1998

[54] ARTICLE OF HEADWEAR

[75] Inventor: Mark Steele, Dunston, United Kingdom

[73] Assignee: Hoodco 446 Limited, Wellington, County Durham, United Kingdom

[21] Appl. No.: 588,135

[22] Filed: Jan. 18, 1996

Related U.S. Application Data

[63] Continuation-in-part of Ser. No. 489,039, Jun. 9, 1995, abandoned.

[51] Int. Cl.[6] ..... A42B 3/04

[52] U.S. Cl. ..... 2/422; 2/425; 359/861; 359/880

[58] Field of Search ..... 2/422, 410, 424, 2/425, 10; 359/880, 861

[56] References Cited

U.S. PATENT DOCUMENTS

| | | | |
|---|---|---|---|
| 3,059,519 | 10/1962 | Stanton . | |
| 3,804,495 | 4/1974 | Bayow et al. . | |
| 3,978,526 | 9/1976 | Mitchell et al. . | |
| 4,354,733 | 10/1982 | Picquet et al. . | |
| 4,651,357 | 3/1987 | Gershoni | 359/880 X |
| 5,124,848 | 6/1992 | Capilupi, Jr. | 359/861 |

FOREIGN PATENT DOCUMENTS

| | | |
|---|---|---|
| 0007432 | 2/1980 | European Pat. Off. . |
| 0099848 | 2/1984 | European Pat. Off. . |
| 0213890 | 3/1987 | European Pat. Off. . |
| 1291711 | 3/1962 | France . |
| 2456648 | 12/1980 | France . |
| 2631789 | 12/1989 | France . |
| 2943472 | 5/1981 | Germany . |
| 2097147 | 10/1982 | United Kingdom . |

*Primary Examiner*—Peter Nerbun

*Attorney, Agent, or Firm*—Woodard, Emhardt, Naughton Moriarty & McNett

[57] ABSTRACT

An article of headwear (10) includes a solid transparent fully carbonate block (18). The block lies on top of the wearer's head and defines a non-straight light path to the wearer's eyes. The block does not obscure the majority of the normal field of vision for the wearer but can be seen when the wearer looks upwards. The upper surfaces 24 of the block allow internal reflection of light through the block and the rear end of the block is open and faces backwards so that by looking upwardly into the block a wearer can obtain a view of what is behind him. The article of headwear may be a motorcycle helmet for example. In another embodiment of the invention a display screen is located at the rear of the block so that it can be seen through the block when the wearer looks upwardly into the block.

1 Claim, 5 Drawing Sheets

ARTICLE OF HEADWEAR

This application is a continuation-in-part of application Ser. No. 08/480,039, filed Jun. 9, 1995, now abandoned.

The invention relates to an article of headwear.

BACKGROUND OF THE INVENTION

It is known to provide an accessory for a motorcycle helmet in the form of a channel which is affixed to the top of the motorcycle helmet longitudinally in the position of a crest. The channel mounts for example three mirrors on its inner surface which are arranged so that the wearer of the helmet can look into the channel and via the mirrors see behind him. The mirrors are separately affixed to the interior surface of the channel.

SUMMARY OF THE INVENTION

According to the invention there is provided a helmet comprising an outer protective shell, a channel through the helmet inside the shell, and a one piece mounting in the roof of the channel mounted to the shell, the mounting carrying or comprising at least one mirror facing from the mounting into the channel, the mirror or mirrors enabling a person wearing the helmet to see through the channel.

The fact that the viewing system is provided within rather than outside the shell of the helmet greatly improves the safety of the helmet. The fact that the mirror or mirrors are carried by or formed on a one piece mounting, simplifies manufacture of the mounting and also enables the mounting together with the mirrors to be easily assembled within the helmet. The fact that the mounting is provided within the helmet also means that it can be made lightweight and the helmet of the invention can be very significantly lighter than the prior known helmet.

The lower surface of the mounting preferably follows the general contour of the shell. The mounting can thus be fitted closely and snugly against the inside of the shell. The mounting will also in this way follow the contour of a wearer's head to improve safety. The mounting may be of substantially constant thickness. This reduces the material required and hence the weight of the mounting. The mounting may conveniently comprise a plurality of substantially planar sections. At least a portion of the mounting may extend from one side of the inner surface of the shell to the other. In this way, the mounting is readily located for fixing and can, if desired reinforce the strength of the shell. Sideways locating means may be provided between the shell and the mounting. The sideways locating means may comprise a rib on one of the shell and the mounting and means defining a groove to receive the rib on the other of the shell and the mounting. The channel may be defined at least partly in a cushioning material such as foam within the helmet and the cushioning material may have increased resilience locally alongside the channel.

Each mirror may take any suitable form and may be electrodeposited onto a surface of the mounting. The mounting may suitably be made of plastics material such as ABS or an alloy of ABS and polycarbonate while the electrodeposited material may be metal and may for example be chromium. There are preferably a plurality of mirrors. The use of an odd number of mirrors results in an image which is the correct way up.

Articles of headwear are known in the form of motorcycle helmets allowing the wearer to see backwards. However, these helmets incorporate individual convex lenses and flat mirrors to direct light through air. The lenses and mirrors, being arranged often approximately radially to a wearer's head, may cause injury to a wearer on impact to the helmet by presenting a low surface area of applied load to the head.

According to one aspect of the invention there is provided an article of headwear including path means defining a non-straight light path to the wearer's eyes, the article not obscuring the majority of the normal field of vision for the wearer, the path means defining the light path being at least 75% continuous.

Preferably the path means is at least 90% continuous, most preferably entirely continuous.

According to another aspect of the invention there is provided an article of headwear including path means defining a non-straight path to the wearer's eyes, the article not obscuring the majority of the normal field of vision for the wearer, the path means comprising at least one transparent block.

Preferably the path means comprises a single transparent block.

In this way, the article of headwear does not include potentially dangerous radially arranged optical elements.

According to a further aspect of the invention there is provided an article of headwear including a path means defining a non-straight path to the wearer's eyes the path means including a continuous body arranged to alter the direction of light passing through it, the inner surface of the body being shaped to follow the approximate contour of at least part of a wearer's head.

In this way any applied impact will be spread by the body over a larger surface area of the wearer's head.

Preferably the continuous body is the entire path means. Each block or the body may be made from any suitable material. Preferably the material has substantial toughness and the material may be polycarbonate.

The article of headwear may be a protective helmet such as particularly a motor cycle helmet but also for example a riding hat, cycle helmet or a security guard's helmet. In that case the path means may be provided inside or outside a shell of the helmet or intermediate these positions but preferably lies inside the shell. The article of headwear may enable viewing at any desired angle via the non-straight path defined by the path means. Where the article of headwear is for an aviator or pilot for example the path means may enable seeing vertically or to either side and indeed the article of headwear may include a plurality of path means if desired. The article of headwear may enable seeing behind the wearer. This may be particularly useful for drivers especially motor cyclists. At present, motor cyclists commonly either look over their shoulder or in handlebar mounted mirrors. Looking over your shoulder means that you are not looking ahead for a significant period of time, while a handlebar mounted mirror often gives a very poor image because of vibration. While a clear view over a narrow field is important for a driver, a wider field of view, possibly of lower quality, may be preferable for a security guard's helmet, for example. A convex final lens may be used. This would give a security guard a better view and hence a better awareness of his overall surroundings.

The path means is preferably directed such that only one eye of a wearer receives an image therethrough. This enables the path means to be more compact and obviates any problems of focusing.

It is known to provide a display for a pilot, for example, in the form of a head up display (HUD) which is deflected to appear in the line of sight. Such a display is normally very close to the pilot's eyes so that he must constantly change his focus from long distance to look out for other airplanes etc. to short distance to see the display. The constant extreme changes of focus can cause eye strain.

According to another aspect of the invention there is provided an article of headwear including path means defining a non-straight path to the wearer's eye, the path means enabling seeing a display spaced from the wearer's eyes.

Because the display is not immediately in front of the wearer's eyes the focal length is increased and eye strain consequently reduced. The display may be provided outside the normal field of view of the wearer. In one preferred embodiment the display is provided towards the back of the wearer's head and in a further embodiment the display may be provided rearwards of the back of the wearer's head. In this way the focal distance is further increased to a more comfortable and normal length.

The article may be arranged such that the display is all or nearly all that the wearer can see, preferably though, the article does not obscure the majority of the normal field of vision for the wearer.

The path means may be at least 75% continuous, preferably at least 90% continuous and may be entirely continuous. The path means may comprise at least one transparent block, which may be made from polycarbonate. The inner surface of the path means may be sloped to follow the approximate contour of at least part of a wearer's head. The path means may be inside a protective shell of the article.

Embodiments of the invention will now be described by way of example and with reference to the accompanying drawings, in which.

Figure 2:
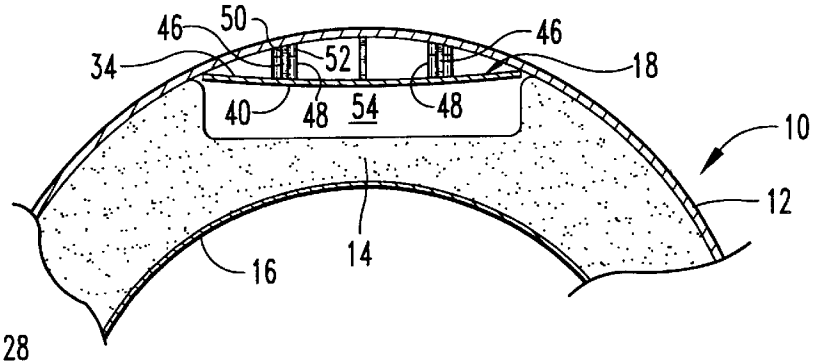
FIG. 2 is a fragmentary detail rear elevation of the helmet of FIG. 1.
Figure 1:
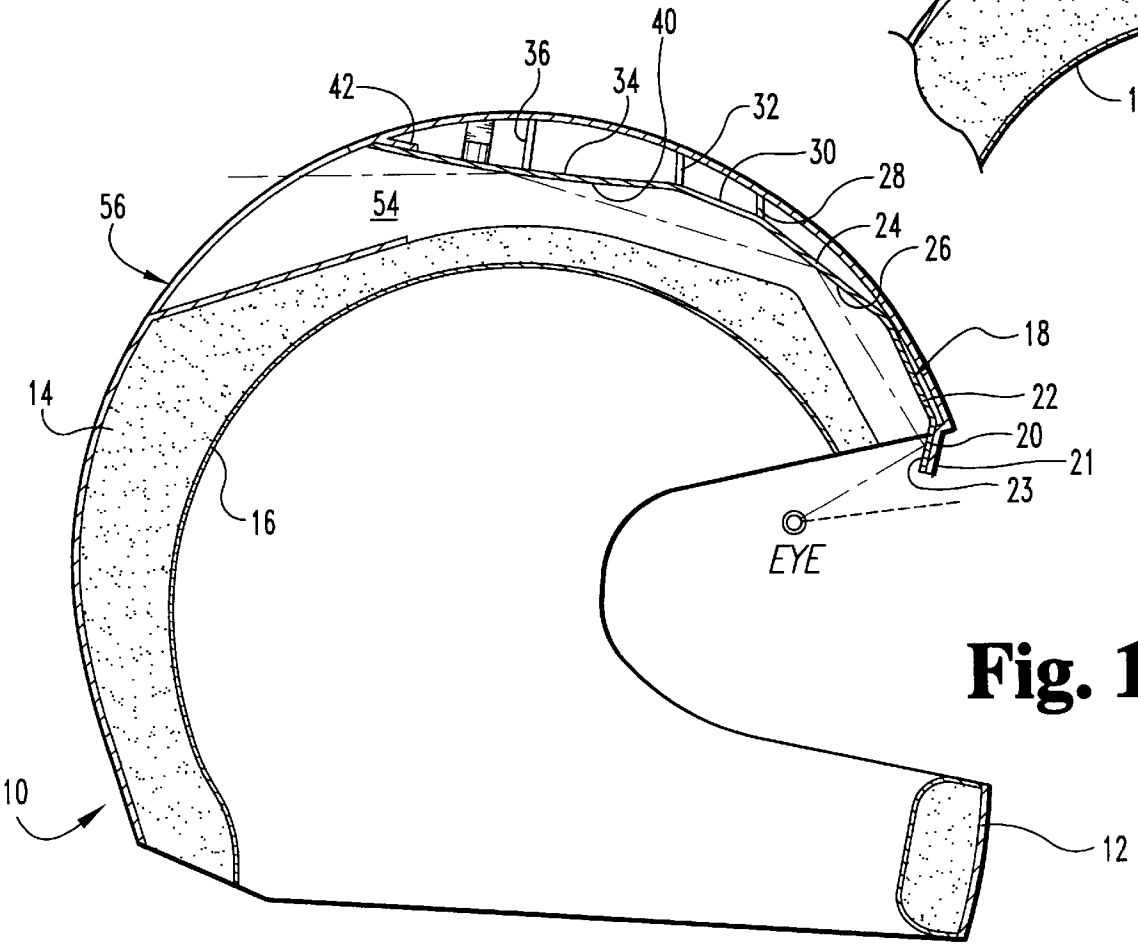
FIG. 1 is a side elevation in cross-section of a helmet according to the first embodiment of the invention.

The helmet 10 of the embodiment comprises an outer shell 12 made of strong plastics material and a soft inner foam layer 14 within the shell 12. A liner 16 which may be made of cloth is shown over the inner surface of the foam 14. A single piece mounting 18 is provided in the roof of the shell 12 and may be made of ABS or a plastics alloy of ABS and polycarbonate. The mounting 18 comprises four planar sections and one slightly convex section serially connected edge to edge. The first planar section 20 lies flat against a planar extension 21 of the outer shell 12 which extends into the upper field of view of the wearer. The inwardly facing surface of the first section 20 is electrodeposited with chromium to form a mirror surface 23. The second planar section 22 extends across the curved part of the shell 12 and is connected at its edge to a third planar section 24, the lower surface of which is metallicized with electrodeposited chromium to form a mirror surface 26. A rib 28 extends upwardly to the shell 12 from the junction between the third planar section 24 and the fourth planar section 30 which is relatively short and a further rib 32 extends from the other edge of the fourth planar section 30 where it is connected to the convex section 34 which leads to the rear of the helmet. A single lateral rib 36 parallel to the ribs 28 and 32 extends centrally from the convex section 34. The convex section 34 is also metallicized on its lower surface to provide a mirror surface 40. A flange 42 extends from the inner surface of the helmet 12 and the rear edge of the convex section 34 lies against the lower surface of the flange 42. The extension 21 and flange 42 assist in locating the mounting 18 longitudinally in the shell 12.Behind the rib 36 are provided three further ribs 44,46 which lie in a longitudinal plane, as shown in FIG. 2. The central rib 44 extends to the inner surface of the shell 12 while the two outer ribs 46 extend from bosses 48 provided on the convex section 34 and are received in grooves 50 defined in bosses 52 depending from the inner surface of the shell 12. A rectangular cross-section channel 54 is defined between the moulding 18 and the foam 14 and leads to a transparent window section 56 of the shell 12.

As the window 56 may constitute a point of weakness, a further flange 58 is provided from the shell 18 extending over the floor of the channel 54 to a position on a radial plane of the helmet 10 intersecting the upper edge of the window 56.

In use, a wearer, by looking at the mirrored surfaces 21,26,40 can see outwardly to the rear of the helmet through the window 56 in the shell 12. The mounting 18 can be injection moulded and the electrodeposited areas can be connected by thin lines so that all three mirror surfaces 23,26,40 can be electrodeposited together for ease of manufacture. In assembly, the mounting 18 complete with mirrored surfaces is simply slid into the channel until the first section 20 lies against the extension 21 of the helmet shell 12 and the rear section 34 of the mounting 18 lies against the flange 42 with the ribs 44,46 in the boss grooves 50 for sideways location and can be glued into place.

The mounting 18 as shown is very lightweight. Alternatively the mounting 18 can be strengthened e.g. of greater thickness or stronger material to reinforce the helmet. Clearly compromises between strength and weight can be struck as desired.

The portion 58 of the foam 14 adjacent the channel 56 may have additional resilience to compensate for the gap constituted by the channel.

In a further embodiment, the ribs 28,32,36 are not provided.

In a still further embodiment, the channel 54 is sealed and may be filled with dry gas or may be evacuated in order to protect the mirror surfaces 23,26,40. In this case, the foam 14 at the floor of the channel 54 would be covered and the front of the channel 54 would be sealed with a further transparent window 56.

In a further embodiment the one-piece mounting 18 provides a fourth mirror surface and a fifth mirror surface is provided at the base of the rear of the helmet 10 on the floor of the channel 54 which will extend over the entire longitudinal circumference of the helmet so that the final mirror surface faces outwardly under the lower edge of the shell 12.

In another embodiment a screen such as an LCD screen may be provided in the channel 54 to provide information to the wearer.

Figure 3:
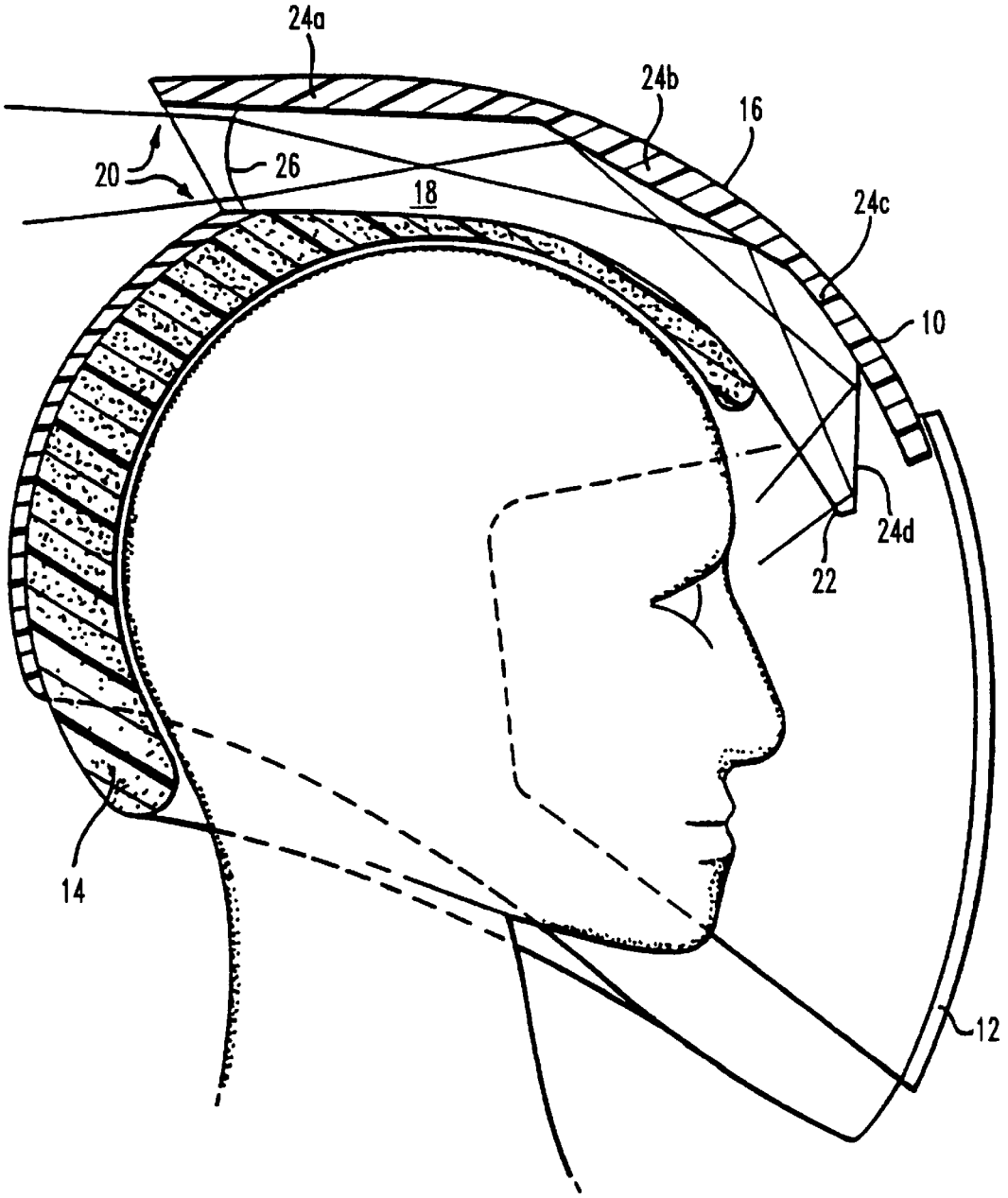
FIG. 3 is a side elevation in cross section of a helmet in a second embodiment of the invention.

FIG. 3 shows a helmet 110, for example, for a motor cyclist. The helmet 110 is of the full face type including a visor 112. The helmet includes inner padding 114 around the wearer's head and an outer hard protective shell 116. At the top of the helmet a continuous solid block 118 of transparent optical material such as polycarbonate is provided between the inner padding 114 and the outer shell 116. The outer shell 116 is stepped at the top rear of the helmet 110 to leave a slot

120 at the rear face of the block 118. The block 118 has a smooth lower surface 122 which substantially follows the contour of the top of the wearer's head H. The lower surface 122 of the block 118 extends downwardly at the front into the upper field of view of the wearer. The upper surface 124 of the block 118 consists of four mirrored planar surfaces 124*a, b, c, d* at shallow angles to one another. The forward-most surface 124*d* tapers the block 118 to meet the lower surface 122. The rearmost surface 126 of the block 118 is convex.

In use the wearer's normal field of forward view is substantially unobscured. When the wearer looks up, however, they will see an image of the view backwards through the slot 120. The light passing through the slot 120 is refracted at the convex surface 118 and is then internally reflected from one or more of the upper surfaces 124*a, b, c* of the block 118 and is finally internally reflected by the forward upper surface 124*d* through the forward lower surface 122 to the eyes of the wearer.

The image received by the wearer is clear because the reflecting surfaces are fixed in relation to the wearer's head/eyes. In the case of an impact, the helmet will act in the usual way because there is still internal padding and an outer shell in direct connection through the large area of the shallow block 118 which covers most of the top of the wearer's head H and has a smooth contoured underside.

The forward upper surface 124d is preferably angled so that the image through the block 118 is only directed to one of the wearer's eyes. This avoids focusing problems. The sides of the block 118 are preferably of matt black colour to limit any distraction for the eye not receiving the image.

If the helmet 110 is to be used by a security guard, for example, the embodiment shown may be adapted to include a block rear surface 126 which is highly convex about an upright axis. The resultant refraction will provide a much wider field of view although of somewhat lower quality due to apparent sideways compression of the image for the wearer.

FIG. 2 shows a helmet which is similar to that of FIG. 3 and only the differences will be described. The same reference numerals will be used for equivalent features.

Figure 4:
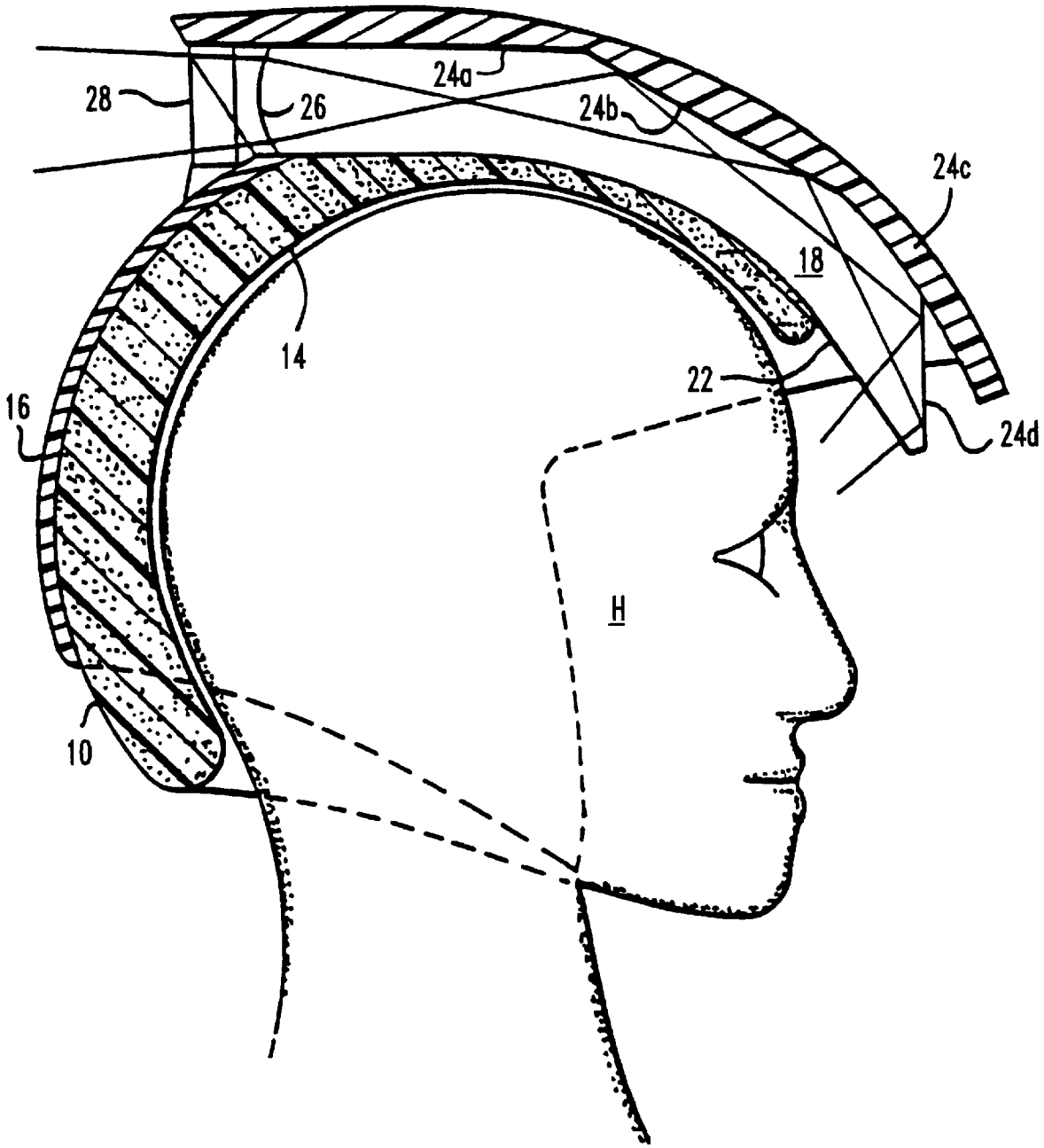
FIG. 4 is a side elevation in cross section of a helmet in a third embodiment of the invention.

The helmet 110 of FIG. 4 is a half-face helmet and includes the same block 118 as the helmet of FIG. 3. However, the slot 120 is blocked by a display 128. The helmet may be used by pilots for example where the display may give flight information. Because the display is at a significant distance from the pilot's eyes, eye strain is reduced. The display may be, for example, an LCD display, back-lit, or any other suitable display.

The helmet 110 could be made without the shell 116 or substantial padding 114 as merely a mounting for the optical block 118 to keep it in place on the wearer's head.

Figure 5:
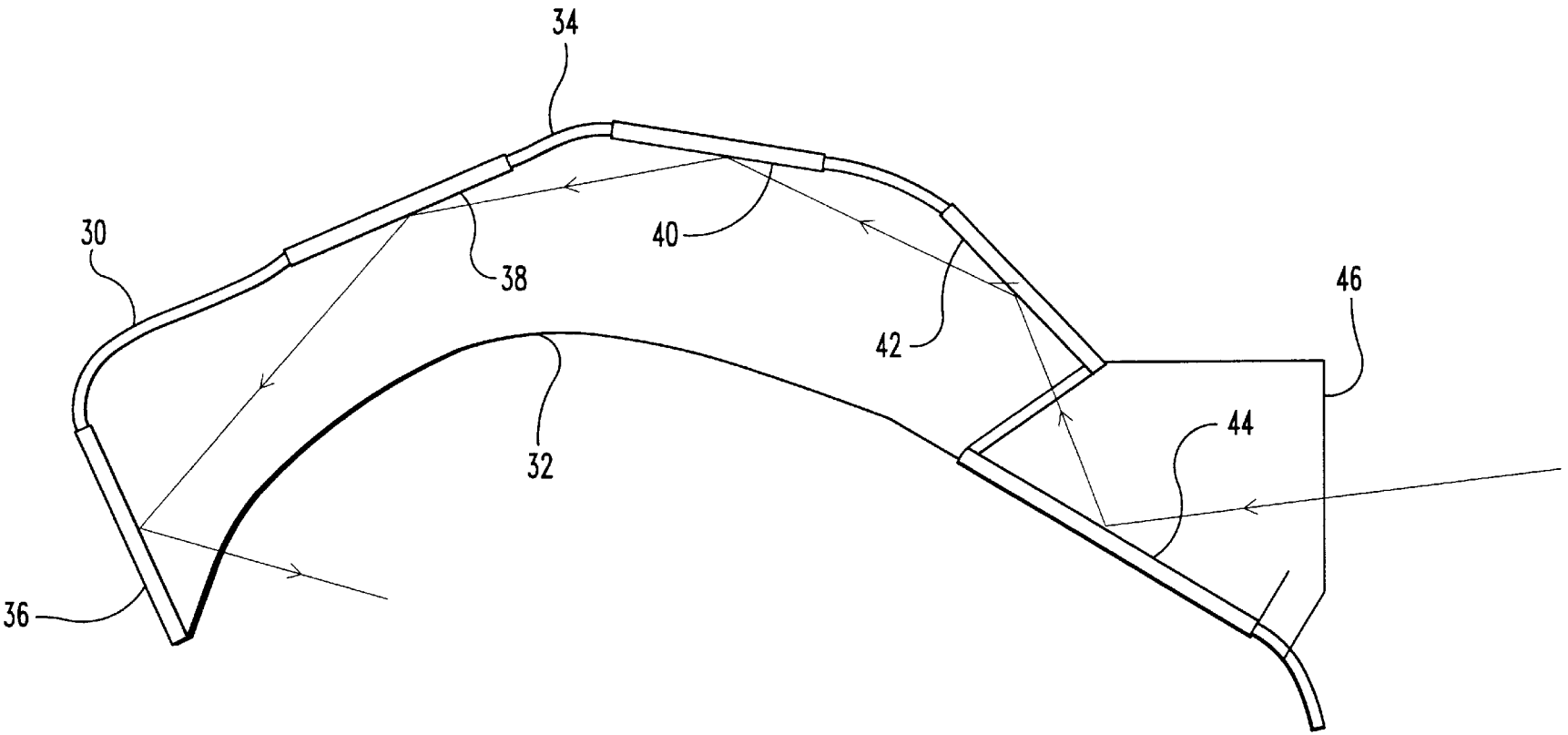
FIG. 5 is a side elevation in cross-section of a block for a helmet in a fourth embodiment of the invention; and, FIG. 6 is a side elevation in cross-section of a helmet in a fifth embodiment of the invention.

FIG. 5 shows the block 130 of a fourth embodiment. The block 130 has a smoothly contoured inner surface 132 to fit onto a wearer's head and has an angled outer surface 134. The angled outer surface 134 defines four mirrored surfaces 136, 138, 140, 142. A fifth mirrored surface 144 is defined at the rear of the mirror surface 132 and the portion 146 of the outer surface 134 opposite the fifth mirrored surface 144 is upright.

The block 130 may be provided for example partly or fully recessed into a cycle helmet. The use of the five mirrored surfaces 136, 138, 140, 142, 144 enables the path into the block 130 to be at a lower level in relation to the wearer's head.

Figure 6:
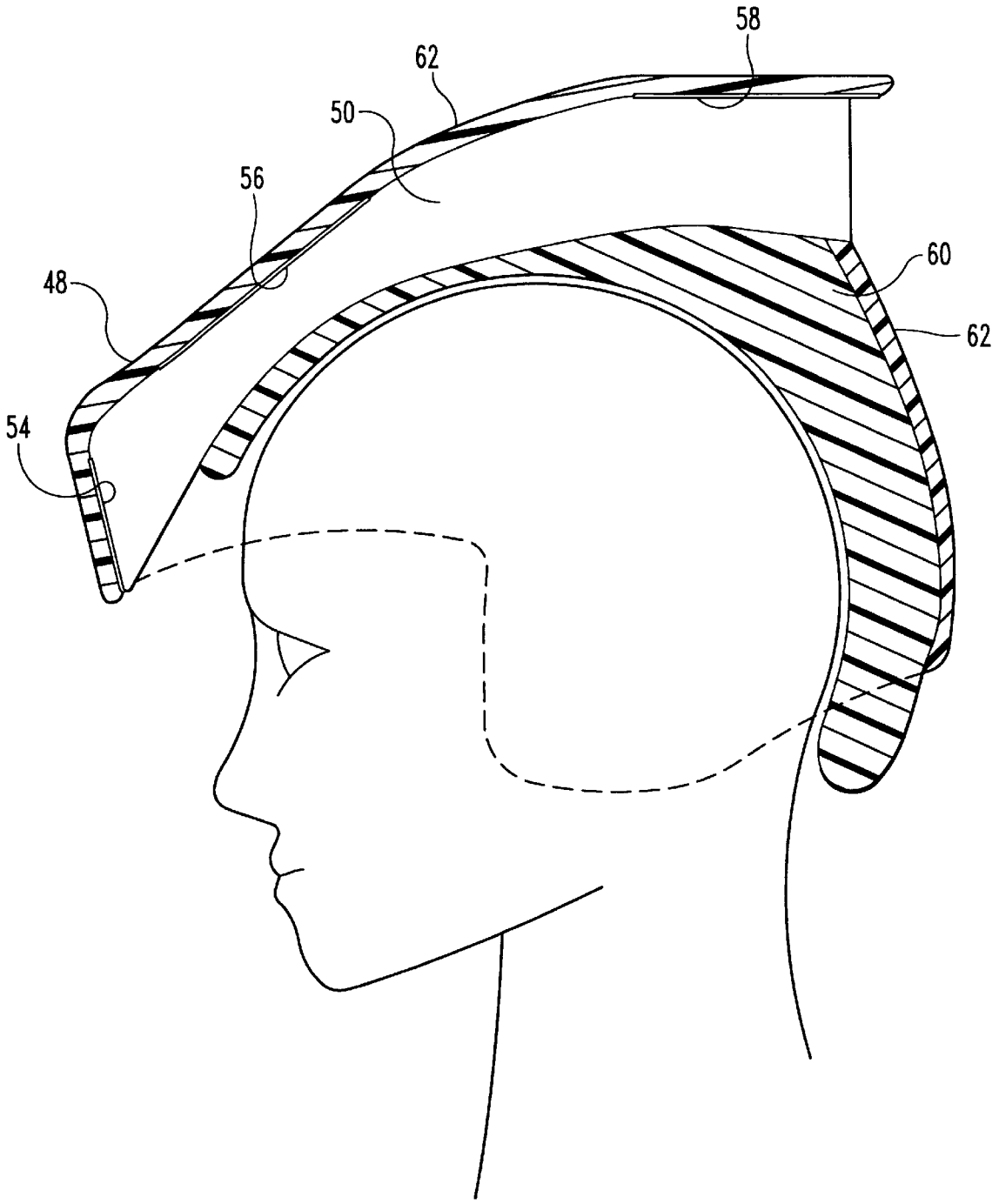

FIG. 6 shows a helmet which is similar to the helmet of FIG. 4 in that it is a half face helmet 148 with a block 150, although the block 150 in this case is for rear view like the helmet of FIG. 3 and does not include a display like the helmet of FIG. 4. The block 150 has an underside 152 which is contoured to the shape of a wearer's head. The upper surface of the block 150 has three distinct, spaced, flat, mirrored surfaces 154, 156, 158. Each surface 154, 156, 158 is silvered to provide reflectivity. The first surface 154 is opposite the wearer's eyes, the second surface 156 is above the wearer's eyes and the third surface 158 is spaced further towards the back of the wearer's head. The block 150 is of polycarbonate and padding 60 is provided between the shell 62 of the helmet 148, the block 150 and the wearer's head.

I claim:

1. A helmet comprising an outer protective shell, a channel through the helmet inside the shell, and a one piece mounting adjacent the roof of the channel mounted to the inside of the shell, the mounting carrying or comprising at least one mirror facing from the mounting into the channel, the mirror or mirrors enabling a person wearing the helmet to see through the channel, and sideways locating means between the shell and the mounting, including a rib on one of the shell and the mounting and means defining a groove to receive the rib on the other of the shell and the mounting.

* * * * *

UNITED STATES PATENT AND TRADEMARK OFFICE
CERTIFICATE OF CORRECTION

PATENT NO : 5,771,497

DATED : June 30, 1998

INVENTOR(S) : Mark STEELE

It is certified that error appears in the above-identified patent and that said Letters Patent is hereby corrected as shown below:

On the title page, item [56]:

Under References Cited, U.S. Patent Documents, line two, please delete the name "Bayow" and insert in lieu thereof --Rayow--.

Signed and Sealed this

Sixteenth Day of February, 1999

*Attest:*

*Attesting Officer*

*Acting Commissioner of Patents and Trademarks*